US006182870B1

(12) United States Patent
Seissler

(10) Patent No.: US 6,182,870 B1
(45) Date of Patent: Feb. 6, 2001

(54) DEVICE FOR HOLDING GARMENTS, PARTICULARLY HOSIERY, WITH A SUSPENSION ARRANGEMENT

(76) Inventor: Walter Seissler, Heringskoop 57, Nordleda 21765 (DE)

( * ) Notice: Under 35 U.S.C. 154(b), the term of this patent shall be extended for 0 days.

(21) Appl. No.: 09/239,202

(22) Filed: Jan. 28, 1999

(30) Foreign Application Priority Data

Jan. 31, 1998 (DE) ..... 298 01 641 U

(51) Int. Cl.[7] ..... A47D 27/22
(52) U.S. Cl. ..... 223/94; 223/91; 223/DIG. 4
(58) Field of Search ..... 223/96, 94, 93, 223/91, 84, DIG. 4; 24/507, 556

(56) References Cited

U.S. PATENT DOCUMENTS

| | | | | |
|---|---|---|---|---|
| 1,206,470 | * | 11/1916 | Rosen | 223/85 |
| 1,400,741 | | 12/1921 | Getgey . | |
| 1,428,274 | | 9/1922 | Corbe . | |
| 2,238,519 | * | 4/1941 | Drake | 223/96 |
| 3,203,061 | * | 8/1965 | Thomas | 223/96 |
| 3,315,679 | * | 4/1967 | Sarracino | 24/561 |
| 5,135,152 | * | 8/1992 | Tsai | 223/85 |
| 5,692,806 | * | 12/1997 | Jones | 24/561 |
| 5,881,931 | * | 3/1999 | Stanfield | 223/85 |

FOREIGN PATENT DOCUMENTS

| | | |
|---|---|---|
| 295958 | 1/1954 | (CH) . |
| 90584 | 4/1896 | (DE) . |
| 1679239 | 6/1954 | (DE) . |
| 1917822 | 12/1964 | (DE) . |

* cited by examiner

*Primary Examiner*—Bibhu Mohanty
(74) *Attorney, Agent, or Firm*—Thomas R. Vigil

(57) ABSTRACT

The object of the invention is a device for holding garments, particularly hosiery, with a suspension arrangement, whereas the device (1) is provided with at least one planiform clamping device (8, 9) with two clamping jaws (11, 21; 30, 40) between which the garment (5) may be clamped. (FIG. 1)

10 Claims, 4 Drawing Sheets

DEVICE FOR HOLDING GARMENTS, PARTICULARLY HOSIERY, WITH A SUSPENSION ARRANGEMENT

CROSS-REFERENCE TO RELATED APPLICATIONS

This application claims priority from German Patent Application No. 298 01 641.9 filed Jan. 31, 1998

BACKGROUND OF THE INVENTION

FIELD OF THE INVENTION

In practice, for drying hosiery, the wet garments are rolled in towels in order to achieve a certain predrying. Thereupon, the garments have to be laid to dry in such a manner that their high own weight due to their wet state does not cause them to lengthen. That means that it is not allowed to hang a knitted pullover for example on a clothes-hanger onto a line, since experience showed that in such a case, such a pullover is losing shape. This is particularly true with cotton pullovers. That is why such a pullover is often laid flat onto a clothes-horse in order to make sure that the pullover or the knitted jacket is not losing shape. Such a drying procedure for hosiery is very complicated and is not necessarily successful, as it is the case, when for example the sleeves of such a garment are hanging down from the clothes-horse due to its size.

SUMMARY OF THE INVENTION

The object of the invention is therefore to provide a device for holding garments, particularly hosiery, permitting to dry them without the garments losing their shape during the drying process.

The solution of this object is to provide the device with at least one planiform clamping device with two clamping jaws between which the garment may be clamped. Thanks to the clamping of the garment between the two clamping jaws of the planiform clamping device, the garment is not losing shape during the drying procedure.

A particularly advantageous embodiment of such a device is characterized by four planiform clamping devices each comprising two clamping jaws between which the garment is clampingly receivable. The four planiform clamping devices are designed for example as lath and are provided at each end with a cramp-like receiving arrangement permitting to slidably fasten them on a rod. Thus, the garment is held clamped on several places so that it cannot sag too much in the free spaces and that there is still enough free space between the different clamping devices in order for the garment to be able to dry. The clamping devices are advantageously showing a perforation in order to allow air circulation even in the areas of the garment that are clamped in.

In order to guarantee effectively that the garment may be received by the clamping jaws in such a way that it cannot slip out of place, the clamping jaws are given, according to another particular characteristic of the invention, on the surfaces facing each other, an outline, particularly an undulated outline, whereas the undulated outline of the two clamping jaws is such that the clamping jaws are superposed, their outlines coinciding. That means that the clamping jaws are superposed so that the top of the wave of one of the clamping jaws is fitting exactly into the bottom of the wave of the other corresponding clamping jaw.

The clamping jaws, which are removably connectable to one another, are moreover provided with clamping means for their interconnection.

According to a second embodiment, the clamping means are provided with snap-in arrangements permitting to removably connect the clamping jaws to one another. These snap-in arrangements ensure that the clamping force exerted by the two clamping jaws onto the garment they are holding between them is continuous, so that it may be increased continuously. The one clamping means is designed more particularly as a cramp, whereas the other clamping means is like a blade whereas the cramp-like clamping means may take hold of the blade-like clamping means. This clearly shows that the two clamping means are slidable together in a snapped-in state, whereas the blade as well as the clamp are advantageously tapered. A holding element is provided to slide the clamping jaws along the clothes-hanger, said holding element being slidably held by the hanger. That means that the spacing between the different clamping devices with their corresponding clamping jaws may be varied.

The invention is described in more details according to the drawing.

DESCRIPTION OF THE PREFERRED EMBODIMENT(S)

Figure 1:
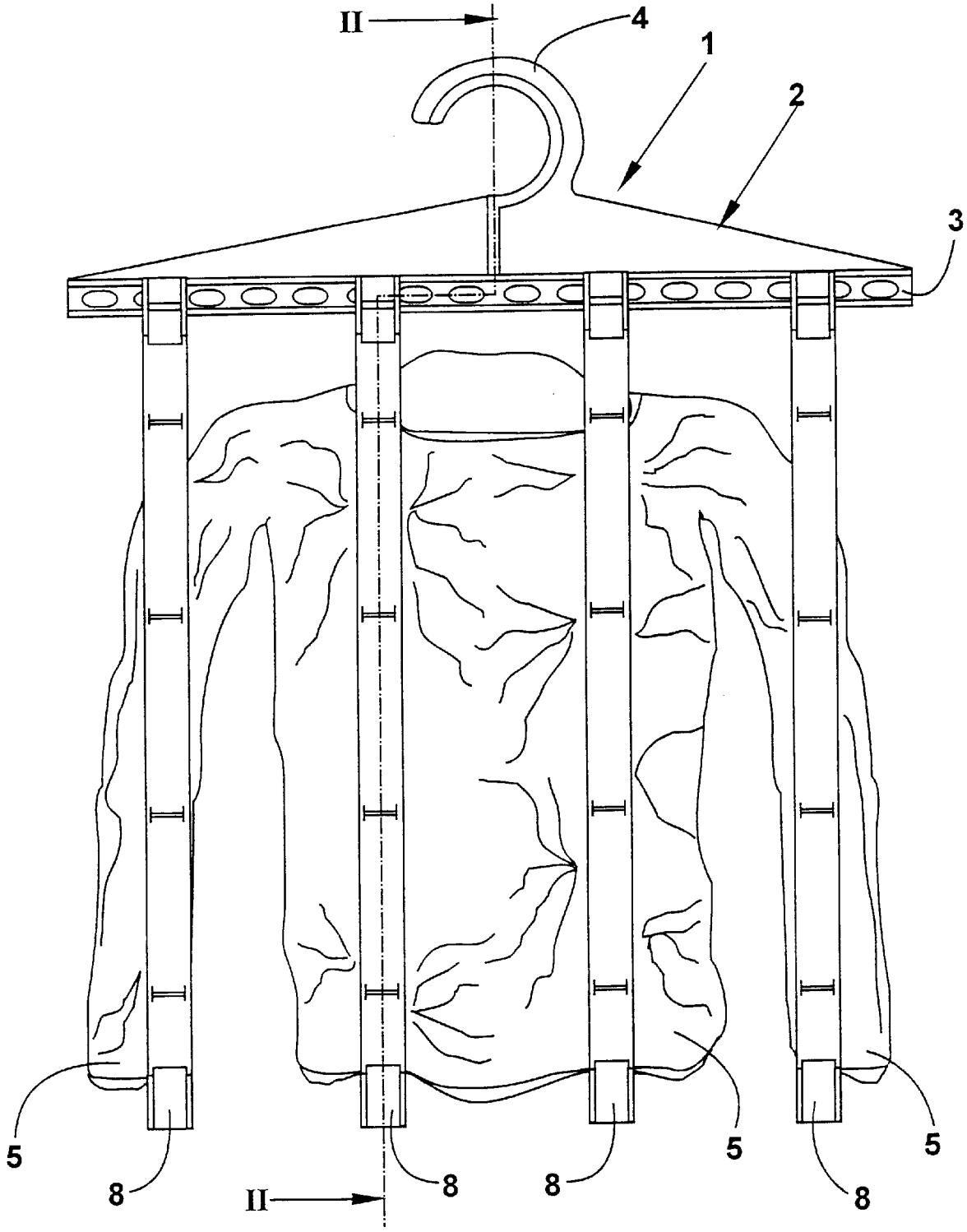
FIG. 1 is a top view of the first embodiment of the device.
Figure 2:
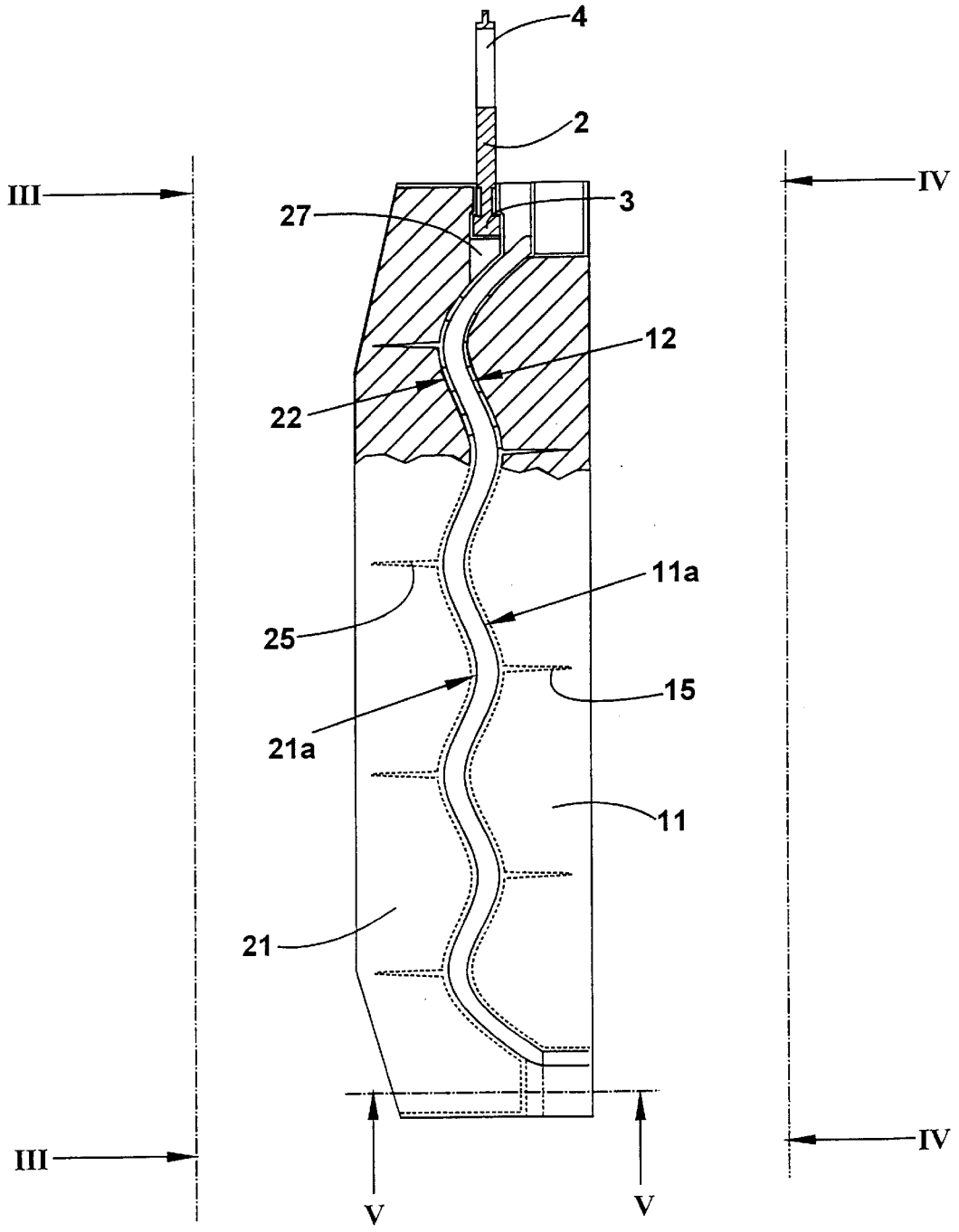
FIG. 2 is a section along the line II—II of FIG. 1.
Figure 3:
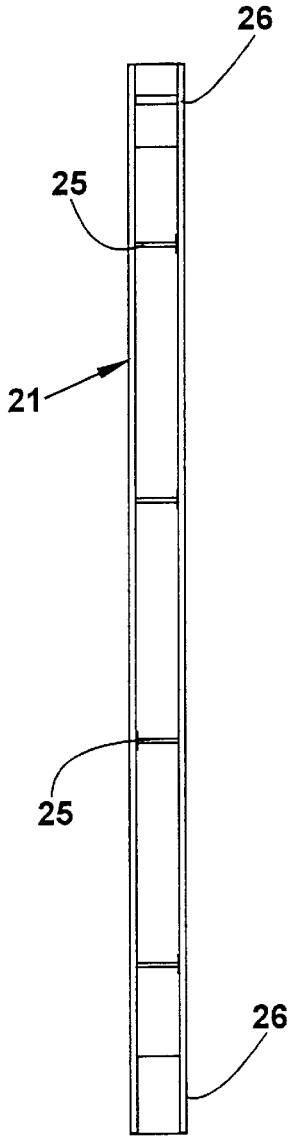
FIG. 3 is a view of the clamping jaw along the line III—III of FIG. 2.
Figure 4:
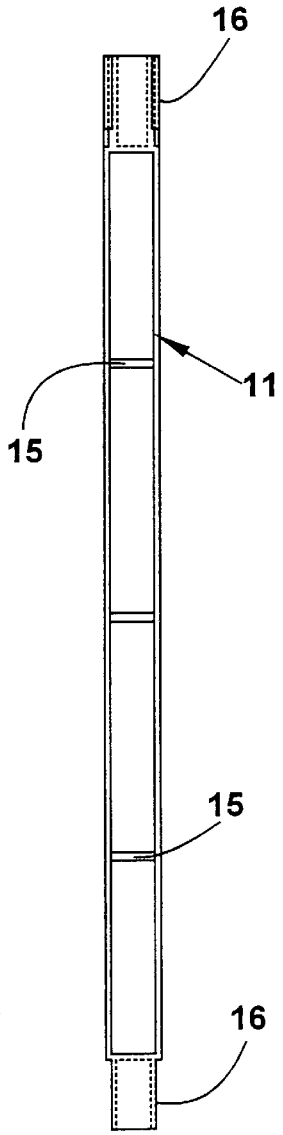
FIG. 4 is a view of the other clamping jaw along the line IV—IV of FIG. 2.
Figure 5:
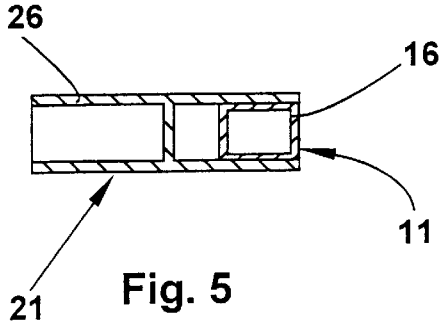
FIG. 5 is a section along the line V—V of FIG. 2.

The device 1 illustrated in FIG. 1 as a top view has a hanger 2 with a rod 3 that slidably receives the four clamping devices 8 with the clamping jaws 11 and 21. The clamping devices 8 are therefor provided at their end with a slot 27 for frictionally and slidably receiving the rod 3 of hanger 2. The different clamping jaws have holes 12 and 22 on their upper side 11*a* and 21*a* respectively, whereas said holes 12 and 22 (FIG. 2) are arranged like a perforation over the whole surface and are intended to facilitate the drying process of the pullover tentered by the clamping jaws in the very area of the clamping jaws. The clamping jaws 11 and 21 are undulated on their faces facing one another in order to facilitate the fastening of pullover 5 tentered in-between the clamping jaws. On their upper side 11*a,* 21*a,* the clamping jaws also have webs 15, 25 whose function it is to stiffen the clamping jaws. The fastening of the clamping jaws 11, 21 on top of one another may be seen in detail in the FIGS. 3 to 5; they clearly show that, for joining the two clamping jaws 11, 21, the two clamping jaws are provided at their respective ends with clamping means 16, 26 corresponding to one another. The clamping means 26 is hereby designed as a shoe-like guide receiving, in a plug-in connection, the clamping means 16 designed as a heel. In plugging the two clamping means together, a clamping connection is achieved between the clamping means 16 and 26 of clamping jaws 11, 21.

Figure 6:
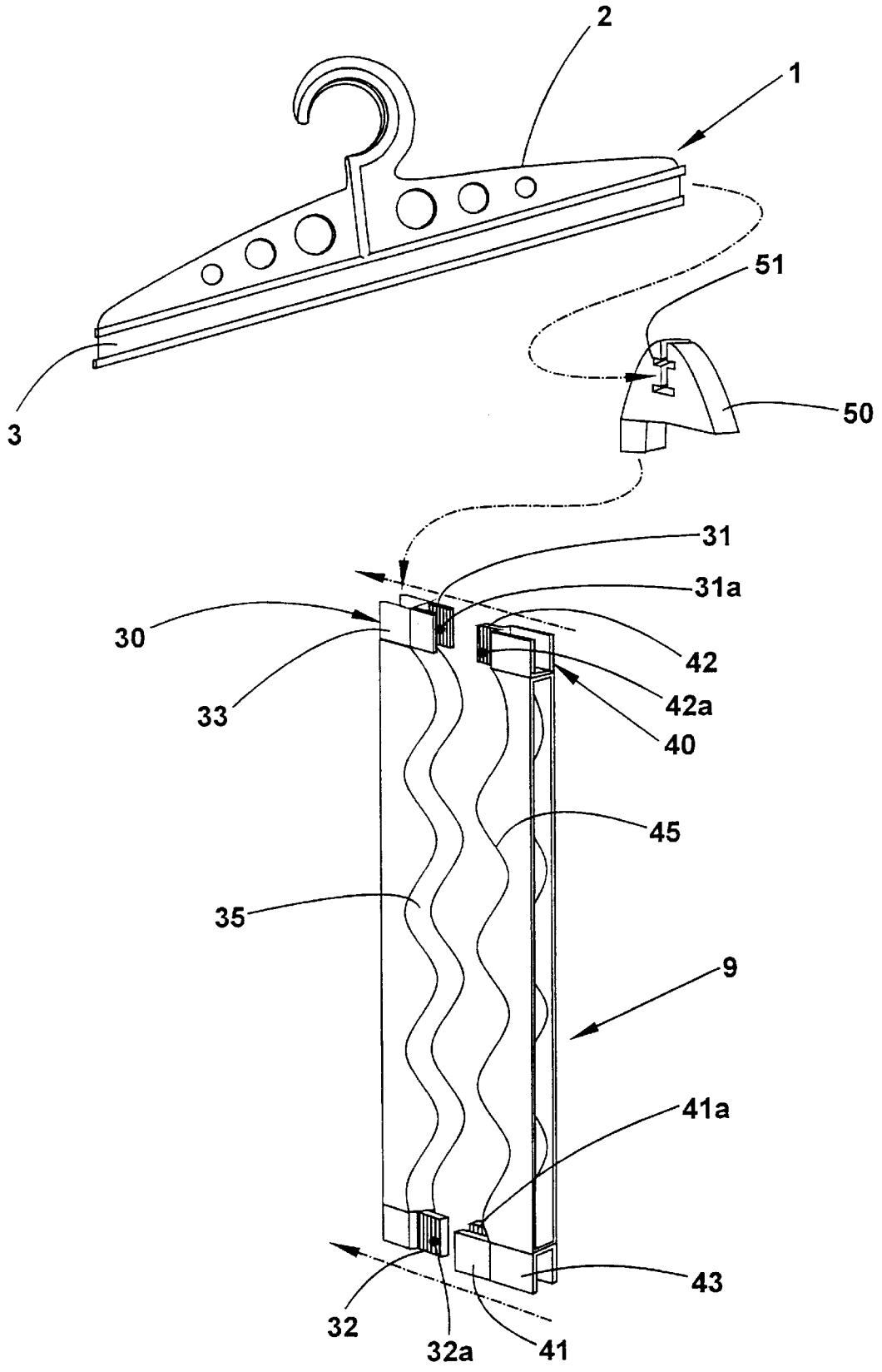
FIG. 6 is a perspective view of a second embodiment.

In the other embodiment (FIG. 6) also, a hanger 2 with a rod 3 is provided, whereas the holding element 50 may be received by the rod 3. This holding element 50 is provided with a recess 51 following the exact outline of rod 3, so that it is slidable along the rod 3. The holding element 50 is receiving the one clamping jaw 30 of the clamping device 9, whereas this clamping jaw 30 has a cramp 31 with snap-in arrangements 31*a* on its upper end and, on its other end, a blade 32 with snap-in arrangements 32*a*. The other clamping jaw 40 of the clamping device 9 is designed accordingly at the corresponding places; that means that it has a blade 42 with a snap-in arrangement 42*a* on its upper end and, on its other end a cramp 41 with an inner snap-in arrangement 41*a*. This clearly shows that the two clamping jaws 30, 40 are slidably fitting into one another thanks to the design of cramp and blade. In order to undo the clamping connection, two push-areas 33 and 43 respectively are provided in the continuity of the cramps 31 and 41. By pushing these areas 33 and 43 respectively together, the cramp 31 and 41 resp. is expanding, thereby releasing the blade 32 and 42 respectively.

According to the first embodiment the clamping jaw 30, 40 shows a wave shaped contour 35, 45 whereas in the area of the contour the clamping jaws are perforated. The rest of the clamping jaws corresponds to that ones of the first embodiment.

I claim:

1. Device for holding garments, particularly wearing apparel including pullovers and hosiery, with a suspension arrangement, said device (1) comprising at least one planiform clamping device (8, 9) with two clamping jaws (11, 21;30,40) between which the garment (5) may be clamped and, characterized in that, for the interconnection of the two clamping jaws (11,21;30, 40), both clamping jaws are provided at their respective ends with matching clamping means (16,21;31,41,32,42).

2. Device according to claim 1, characterized in that the device (1) is provided with four planiform clamping devices (8, 9) each comprising two clamping jaws (11, 21; 30, 40) between which the garment is clampingly receivable.

3. Device according to claim 2, characterized in that the clamping device is provided at its end with a slot (27) for slidably receiving a rod (3) of said device.

4. Device according to claim 1, characterized in that the clamping jaws (11, 21; 30, 40) are given, on the surfaces facing each other, an outline (11*a*, 21*a*; 35, 45), whereas the outline of the two clamping jaws is such that the clamping jaws are superposed, their outlines coinciding.

5. Device according to claim 4, characterized in that the outline (11*a*, 21*a*; 35, 45) is undulated.

6. Device according to claim 1, characterized in that the clamping jaws (11, 21; 30, 40) are provided with a perforation (12, 22).

7. Device according to claim 1, characterized in that the clamping jaws (11, 21; 30, 40) are removably connectable to one another.

8. Device according to claim 1, characterized in that the clamping means (31, 42, 32, 41) are provided with snap-in arrangements (31*a*, 32*a*, 41*a*, 42*a*) permitting to removably connect the clamping jaws (30, 40) to one another.

9. Device according to claim 1, characterized in that the one clamping jaw (30) of the pair of clamping jaws has a holding element (50) whose function it is to slidably connect them to the suspension arrangement (2).

10. Device according to claim 8, characterized in that one portion of the each clamping means (31,41) is designed as a U-shaped grip, whereas another portion of each clamping means (32, 42) is like a blade so that the U-shaped grip portion can grip the blade portion at the respective ends of the clamping means.

* * * * *

UNITED STATES PATENT AND TRADEMARK OFFICE

CERTIFICATE OF CORRECTION

PATENT NO. : 6,182,870 B1
DATED : February 6, 2001
INVENTOR(S) : Walter Seibler

It is certified that error appears in the above-identified patent and that said Letters Patent is hereby corrected as shown below:

Title page,
Please change the name of the inventor from "Walter Seissler" to -- Walter Seibler --.

Column 1,
Line 46, "cramp" should be -- clamp --.

Column 2,
Lines 8 and 9, "cramp" should be -- clamp --.

Column 3,
Lines 1, 7, 10 and 13, "cramp" should be -- clamp --.
Line 12, "cramps" should be -- clamps --;

Signed and Sealed this

Third Day of December, 2002

JAMES E. ROGAN
*Director of the United States Patent and Trademark Office*